United States Patent [19]

Martinelli

[11] 4,106,653

[45] Aug. 15, 1978

[54] TEARABLE BOTTLE CAP

[76] Inventor: Luciano B. Martinelli, 418 Sevilla, Coral Gables, Fla. 33134

[21] Appl. No.: 806,079

[22] Filed: Jun. 13, 1977

[51] Int. Cl.[2] ..... B65D 41/48

[52] U.S. Cl. ..... 215/256; 215/344; 215/DIG. 1

[58] Field of Search ..... 215/254, 256, 344, DIG. 1

[56] References Cited

U.S. PATENT DOCUMENTS

| | | | |
|---|---|---|---|
| 2,752,059 | 6/1956 | Schneider | 215/DIG. 1 |
| 3,325,033 | 6/1967 | Wheaton | 215/254 |
| 3,367,524 | 2/1968 | Lake | 215/256 |
| 3,434,613 | 3/1969 | Langecker | 215/256 |
| 3,672,528 | 6/1972 | Faulstich | 215/256 |
| 3,940,004 | 2/1976 | Faulstich | 215/256 |
| 3,979,002 | 9/1976 | Faulstich | 215/256 |
| 3,985,255 | 10/1976 | Blair | 215/254 |
| 4,032,029 | 6/1977 | Cochrane | 215/256 |

FOREIGN PATENT DOCUMENTS

| | | | |
|---|---|---|---|
| G11668 | 10/1956 | Fed. Rep. of Germany | 215/256. |

*Primary Examiner*—Donald F. Norton
*Attorney, Agent, or Firm*—Salvator G. Militana

[57] ABSTRACT

A plastic water-tight cap for a water bottle that has a tearable portion that permits the reuse of the cap having a tab portion depending from a skirt portion, score lines alongside the tab portion and extending about the skirt portion and a pair of reinforcement members extending along the skirt portion whereby upon pulling upwardly on the tab portion, the latter and a part of the skirt portion are severed from the cap leaving the skirt portion at the position of the reinforcement members as a tab that permits the reuse of the cap for resealing the water bottle.

1 Claim, 6 Drawing Figures

TEARABLE BOTTLE CAP

BACKGROUND OF THE INVENTION

1. Field of the Invention

This invention is directed to an improved reusable plastic water bottle cap normally used on five gallon water bottles.

2. Description of the Prior Art

The conventional bottle closure caps for water bottles intended to be reused have one of the three characteristics that do not permit the ready and convenient reusability of the cap and resealing the water bottle. One such plastic cap has a tab portion that is not severed and removed from the cap when the user wishes to open the bottle for the first time. The partially torn tab remains on the cap as a further tab when replacing and removing the cap from the bottle. Some plastic caps that provide tabs that are completely severed from the reusable portion of the cap do not have a second tab to permit the removing and replacing of the cap after it had been initially removed from the water bottle. Other plastic caps are incapable of being water-tight after having been initially removed from the water bottle. The present invention contemplates providing a reusable cap for water bottles having a tab for the initial removal of the cap and a second tab formed upon the removal of the first tab to permit the reusing of the cap and maintaining the cap in water-tight condition.

SUMMARY OF THE INVENTION

Therefore, a principal object of the present invention is to provide a tearable plastic cap for water bottles that has a tab that permits the removal of the plastic cap initially and a second tab formed upon the severing of the first tab from the cap to permit the reusing of the cap.

Another object of the present invention is to provide a tearable plastic cap for water bottles that has an upper and lower bead, wherein the cap is reusable having a tab and skirt portion that is severed from the cap upon the initial removal of the cap from the bottle wherein the cap is provided with an external bead having a plurality of ridges of increasing cross sections that engage the upper bead and render the cap water-tight at all times.

A further object of the present invention is to provide a reusable plastic cap for water bottles having a skirt portion, a tab, and score lines permitting the severing of the tab and a portion of the skirt from the cap upon the initial removal of the cap from the water bottle and simultaneously forming a second tab for the ready reuse of the cap. A still further object is to provide a reusable plastic cap for water bottles that is water-tight at all times.

With these and other objects in view, the invention will be best understood from a consideration of the following detailed description taken in connection with the accompanying drawing forming a part of this specification, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
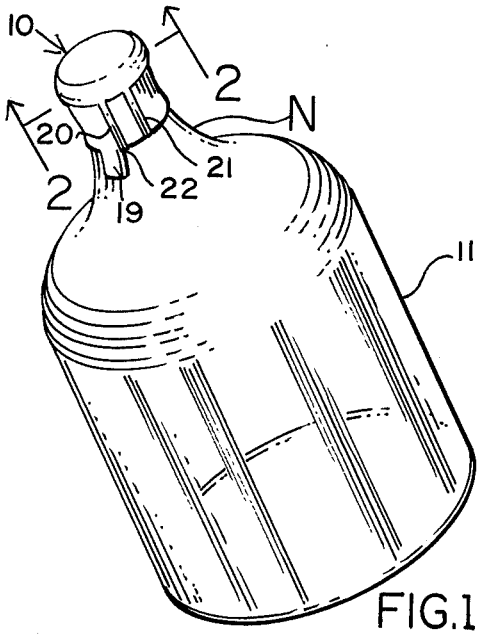
FIG. 1 is a perspective view of a conventional five gallon water bottle on which my reusable tearable bottle cap is shown sealing the contents of the water bottle.
Figure 2:
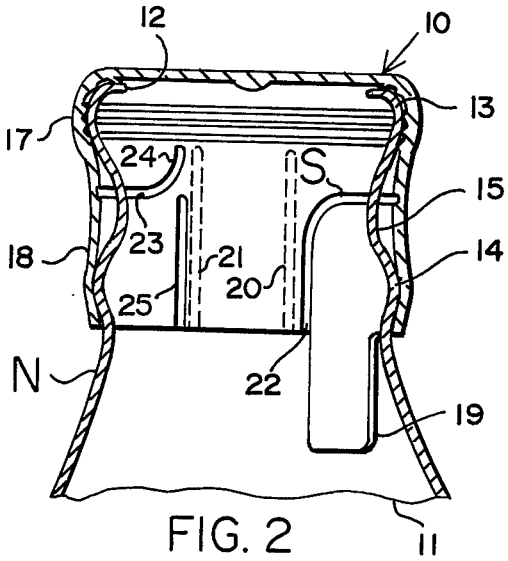
FIG. 2 is a cross sectional view taken along the line 2—2 of FIG. 1.

Referring to the drawing wherein like numerals are used to designate similar parts throughout the several views, the numeral 10 refers to my plastic bottle cap shown in position over the neck -N- of a conventional plastic water bottle 11, at whose free and open end of the neck -N- is an inwardly extending lip portion 12 adjacent to which is an upper bead 13. There is a lower bead 14 about the neck of the bottle 11 joining the upper bead 13 by means of a minimum or reduced diameter portion 15. My bottle cap 10 is as explained in detail hereinafter engages the upper and lower beads 13 and 14 to render the bottle 11 leakproof when the cap 10 is in its initial position thereon.

Figure 5:
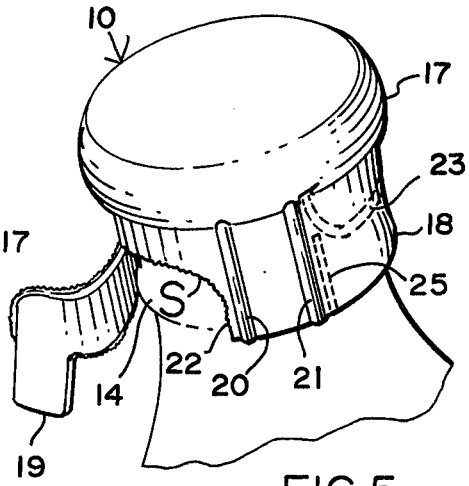
FIG. 5 is a perspective view of my bottle cap showing the cap being torn from the neck of a water bottle.
Figure 6:
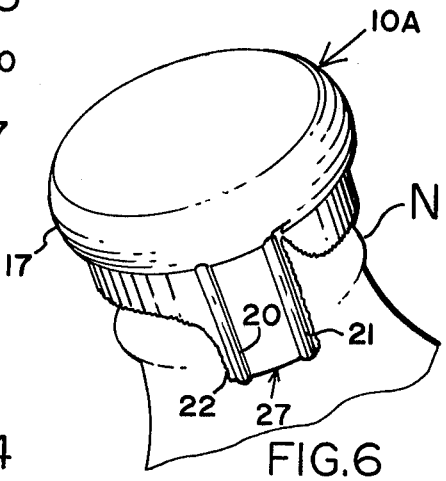
FIG. 6 shows the reusable bottle cap portion after the original bottle cap has been removed from the water bottle and recapped to reseal the water bottle.

The tearable plastic cap 10 consists of a top circular disk portion 16 of approximately the same diameter as that of the outlet 26 formed by the lip portion 12 of the bottle 11 with an external bead 17 extending about the periphery of the disk 16 and engaging the upper bead 13 in water-tight relation. Extending from the lower edge of the external bead 17 is a skirt 18 that extends downwardly to engage the lower bead 14 of the bottle neck -N- and render the juncture thereof also water-tight. Extending from the lower edge of the skirt 18 is a pull tab 19. Mounted on the outer surface of the skirt 18 is a pair of ribs or reinforcements 20, 21 extending from the external bead 17 to the lower edge of the skirt 18. The rib 20 is positioned in proximity of the pull tab 19 while the external bead 21 is parallel to but spaced from the external bead 20. On the inner surface of the skirt 18 is a continuous score line -S- commencing at the lower edge of the skirt 18 as at 22 between the pull tab 19 and reinforcement member 20 extending upwardly to an upward portion of the skirt 18 below the external bead 17 as at 23 wherein the score line extends peripherally about the skirt 18 to the rib 21 where the score line -S- extends upwardly as at 24 to terminate at the position of the external bead 17 adjacent to the reinforcement member 21. There is a second score line 25 that is formed on the inner surface of the skirt 18 that extends alongside the rib 21 which is on the outside surface of the skirt 18. The score lines -S- and 25 are sufficiently deep so that when a person grips the pull tab 19 and pulls upwardly and outwardly as shown by FIG. 5, the skirt 18 will commence tearing at 22 and tear along the score lines -S- (23) and 25 and become separated from the cap 10 to be removed from the bottle 11 as shown by FIG. 6, and the remainder of the cap 10 indicated as 10A reused as explained in detail hereinafter.

Figure 3:
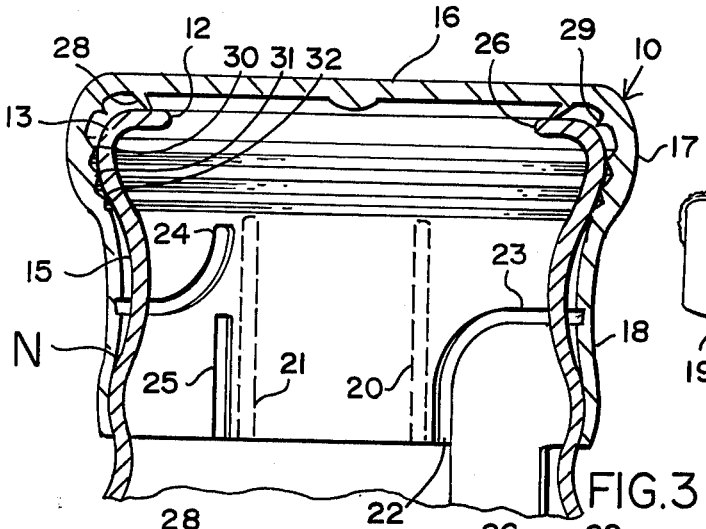
FIGS. 3 and 4 are enlarged and detailed similar views showing the cap prior to and after being positioned on the bottle in water-tight condition.
Figure 4:
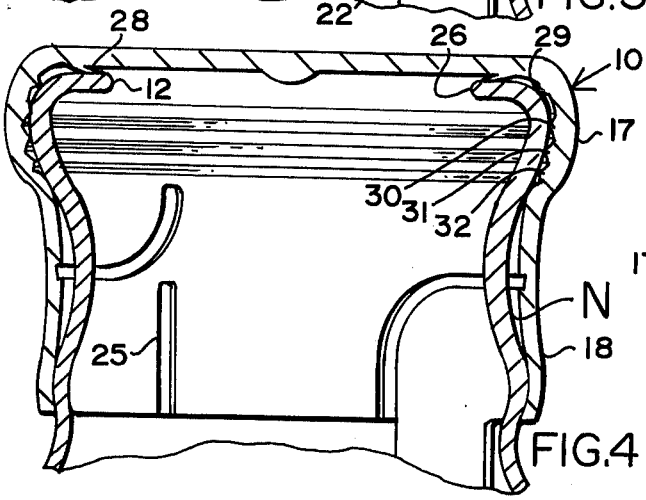

In order to render the cap 10 leakproof both when the bottle cap 10 is originally placed on the neck -N- of the bottle 11 and after the cap 10A has been removed and reused on the bottle 11, the cap 10 is provided with a plurality of peripheral raised members on the inside surface of the external bead 17 of the cap 10 engaging the upper bead 13 of the bottle 11. Adjacent to the outlet 26 of the bottle 11, the first raised peripheral surface consists of a finger portion 28 that engages circumferentially the lip portion 12 of the bottle 11. The finger portion 28 extends beyond the inner surface of the cap 10 such a distance that when the cap 10 is pressed tightly in position over the neck -N- as shown progressively by FIGS. 3 and 4, the finger portion 28 engages the lip 28 peripherally and along its full width to prevent any leakage of water therealong. There is a second peripheral bead or ridge 29 extending about the inner surface of the cap 11 that engages the top portion of the upper bead 13 of the bottle 11 and a plurality of ridges 30, 31 and 32 that engage the side wall of the upper bead 13. The ridges 30, 31 and 32 vary in size, the ridge 30 being smaller in width than that of the ridge 31 which in turn is smaller than that of the ridge 32. This structure permits a tight frictional engagement of the ridges 31, 31 and 32 with the outer surface of the upper bead 13 to thereby render the juncture therebetween water-tight.

In the normal use of my tearable plastic bottle cap 10, the cap 10 is fitted over the neck -N- after the bottle has been filled with water preparatory to being sold and delivered to the user thereof. See FIGS. 1-4 inclusive. The skirt 18 of the cap 10 will engage the lower bead 14 of the water bottle 11 while the ridges 28, 29, 30, 31 and 32 engage lip portion 12 and the uppr bead 13 of the water bottle 11 to render the cap 10 water-tight. When it is desired to partake of the water contained in the water bottle 11, the user grasps the pull tab 19 and pulls upwardly thereon to cause the latter to tear along the score line -S- commencing at the edge portion 22 and continuing along portion 23 to the terminus 24 at which time the user causes the cap 10 to tear along the score line 25 upwardly to its upper end portion to join the score line 24. At this time the combined tab portion 19 and skirt 18 become severed and removed from the cap 10 as shown by FIG. 6 to form the reclosure cap 10A. Now the remaining ribs 20, 21 form a reinforced tab 27 for removal of the cap 10A from the neck -N- of the bottle. The tab 27 also assists the user in replacing the cap 10A on the bottle 11 without contaminating the spout portion of the neck -N- or the inner surface of the reclosure cap portion 10A so that the water in the bottle 10 remains uncontaminated as long as the water remains in the bottle 10 until finally dispensed.

What I claim as new is:

1. In the neck of a water bottle having a mouth portion, an upper and a lower bead and a neck portion of reduced diameter joining said upper and lower beads and a lip portion, a tearable plastic cap comprising a disk portion extending across the mouth of said neck portion having an inwardly extending peripheral finger portion engaging said lip portion, an external bead portion engaging said upper bead and a skirt portion extending downwardly from said external bead portion, across said neck portion of reduced diameter and engaging said lower bead, said external bead portion having a plurality of peripheral ridge portions on the inner surface thereof in water-tight relation with said upper bead, said peripheral ridge portions being of decreasing cross sectional areas engaging said upper bead from the upper to the lower portions thereof, a pair of spaced apart reinforcement members extending downwardly on the outer surface of said skirt portion from said external bead portion, a tab portion extending downwardly from said skirt portion, and a plurality of score lines formed along the inner surface of said skirt portion for the removal of said tab portion and said skirt portion, one of said score lines commencing at the lower portion of said skirt portion between said tab portion and one of said reinforcement members, extending upwardly to a position below said external bead, peripherally about said skirt and terminating at the upper portion of the other of said reinforcement members and a second score line extending alongside said other of said reinforcement members and terminatin proximity of the terminal end of said one of said score lines whereby upon grasping said tab portion and tearing said skirt along said score lines said tab and a portion of said skirt become separated from said cap and said cap becoming removable from said water bottle and that portion of said skirt portion between said reinforcement members becoming a second tab to permit reuse of said cap.

* * * * *